US005826555A

United States Patent [19]

Aronsson et al.

[11] Patent Number: 5,826,555

[45] Date of Patent: Oct. 27, 1998

[54] STARTER DEVICE

[75] Inventors: Tore Aronsson, Mölndal; Ove Donnerdal, Partille, both of Sweden

[73] Assignee: Aktiebolaget Electrolux(publ)., Sweden

[21] Appl. No.: 881,790

[22] Filed: Jun. 24, 1997

[30] Foreign Application Priority Data

Jun. 26, 1996 [SE] Sweden ..... 9602519

[51] Int. Cl.[6] ..... F02N 3/02

[52] U.S. Cl. ..... 123/185.3

[58] Field of Search ..... 123/185.2, 185.3, 123/185.4

[56] References Cited

U.S. PATENT DOCUMENTS

| | | | |
|---|---|---|---|
| 2,868,186 | 1/1959 | Schnacke et al. | 123/185.4 |
| 3,306,277 | 2/1967 | Gudmundsen | 123/185.3 |
| 4,019,490 | 4/1977 | Reese | 123/185.3 |
| 4,426,961 | 1/1984 | Grinde | 123/185.3 |
| 4,480,605 | 11/1984 | Bloemers | 123/185.3 |
| 4,492,190 | 1/1985 | Greenwood et al. | 123/185.3 |
| 5,014,657 | 5/1991 | Tsunakawa et al. | 123/185.3 |

FOREIGN PATENT DOCUMENTS 41 10 753 C2 4/1992 Germany .

OTHER PUBLICATIONS

Derwent Publication Abstract of 86–210723/32, SU1201545–A.

*Primary Examiner*—Andrew M. Dolinar
*Attorney, Agent, or Firm*—Michael D. Bednarek; Kilpatrick Stockton LLP

[57] ABSTRACT

A starter device for an internal combustion engine comprises a unit (1) which is fixed relative to the engine, a movable unit (2) which is rotatable relative to the fixed unit about an axis of rotation (28), included in the movable unit (2) on the one hand a cord drum (42) with a starter cord (47) and on the other hand a driver device (58) for direct or indirect rotation of the engine shaft on rotation of the cord drum by pulling the starter cord, a return spring chamber (4) accommodating a return spring (3) arranged to be tensioned when the movable unit is rotated by pulling the starter cord and subsequently, by resilience, to return the cord drum to its initial position, and also at least one bearing between said fixed and movable units (2, 1). The special characteristic is the presence of at least one axially acting spring member (5) for pressing the movable unit in the axial direction against a member (36) forming part of the fixed unit, and also at least one sealing member (65, 40, 41) between the environment and at least one of said return spring chamber and said bearing.

20 Claims, 5 Drawing Sheets

STARTER DEVICE

TECHNICAL FIELD

The invention relates to a starter device for an internal combustion engine, comprising a unit which is fixed relative to the engine, a movable unit which is rotatable relative to the fixed unit about an axis of rotation, included in the movable unit a cord drum with a starter cord and a driver device for direct or indirect rotation of the engine shaft on rotation of the cord drum by pulling the starter cord, a return spring chamber accommodating a return spring arranged to be tensioned when the movable unit is rotated by pulling the starter cord and subsequently, by resilience, to return the cord drum to its initial position, and also at least one bearing between said fixed and movable units.

BACKGROUND OF THE INVENTION

For smaller internal combustion engines for a large number of mobile and also stationary work tools, such as chain saws, clearing saws, cross-cutting saws, lawn mowers, rotary snow-ploughs and the like, as well as for outboard engines etc., use has been made of starter arrangements of the type indicated above for a very long time, in fact practically ever since internal combustion engines were first used for this type of machine, and still is made now. Examples of two recent designs are illustrated in DE 41 10 753 and U.S. Pat. No. 5,014,657.

It is a well-known fact among both designers and users that this conventional type of starter device has certain shortcomings. As far as the user is concerned, this may manifest itself in the device starting to run stiffly, which gradually leads to the starter cord not being pulled completely back into the starter device when it is released after the engine has been started or an attempt at starting has been made. The end of the cord with the starter handle remains hanging and may become entangled in various objects, and may thus gradually break or in any case have an inconvenient effect. If the entire length of the starter cord cannot be used for the starting operation, the starter device is of course less effective and the engine more difficult to start; and if the starter cord has broken, it is impossible to start the engine.

It has also been known for a long time among experts within manufacturing that the stiff running is due to dust and other impurities penetrating the return spring chamber and/or the bearing between the movable unit with the cord drum and the fixed unit. If lubricant is applied to the bearing, the friction can certainly be reduced for a time but a thick paste is soon formed instead which has a wearing effect and also contributes directly to the stiff working. It is in itself conceivable to prevent dust and other impurities gaining access to the bearing and/or the return spring chamber by means of seals of various types, but in designs which have existed thus far all seals have worn out rapidly as a result of vibrations caused by the engine and/or by the machine which is driven by the engine. It is true that non-sliding seals, e.g. seals of the labyrinth type, can be envisaged in starter devices which have been proposed or existed previously, but these then have to be made with such great play that they become very ineffective. Furthermore, this play, in conjunction with relative movements between elements of the labyrinth seal, can lead to air and thus dust also being actively pumped in and through the seal.

BRIEF DESCRIPTION OF THE INVENTION

The basis of the invention is the understanding that the abovementioned problems are caused by the vibrations from the engine and/or from the machine which is driven by the engine. If it is prevented or essentially counteracted that these vibrations make the movable unit oscillate relative to the fixed unit—"rattle"—it is possible to arrange seals with a long service life in strategic places, which seals can, in the intended manner, prevent or essentially counteract dust and other impurities penetrating the bearing and/or the return spring chamber. One aim of the invention is to bring this about, which is possible by the arrangement of at least one axially acting spring member which presses the movable unit in the axial direction against the fixed unit and by at least one sealing member being arranged between the environment and at least one of said return spring chamber and said bearing, preferably between the environment on one hand and the return spring chamber and the bearing on the other hand. It is not important in which axial direction the movable unit is pressed against the fixed unit. What is important is that the movable unit lies fixed in the axial direction relative to the fixed unit, so that the units do not move in relation to one another when they are exposed to vibration forces in different directions. This can be achieved by the axially acting spring member(s) developing a spring force which is greater than the vibration forces which act in the axial direction on the movable unit relative to the fixed unit. This can also be expressed as the movable unit being pressed in the axial direction against a member forming part of the fixed unit with a force which exceeds the axial pulse forces which act on the movable unit relative to the fixed unit as a result of vibrations in the engine and/or the machine or apparatus which is driven by the engine. These pulse forces can vary from case to case depending on the construction of the engine and of the driven machine but, in modern engines, machines and apparatus, normally amount to the order of size of 50 g (g force) calculated on the mass of the movable unit.

By virtue of the fact that the vibration problem has been solved, great opportunities are afforded for designers to design appropriate, effective sealing members. Examples of these will be given in the following detailed description of two embodiments of starter devices according to the invention and in themselves amount to improvements in relation to the prior art. According to one embodiment of the sealing members, these are arranged with a view to minimizing the wear on the seals so that these have a long effective life even if the axially acting spring members should be worn out or eliminated entirely.

According to the invention, the bearing(s) can be designed in a number of different ways. Preferably there is a bearing of the radial bearing type in one of said fixed and movable units and a spindle which is mounted rotatably in the radial bearing and belongs to the second of the two units. Expediently, the spindle consists of a male element on the fixed element, the movable part being designed with a hub part, but die opposite arrangement is also possible, namely that the movable element is provided with a male element in the form of a spindle mounted in the fixed unit.

Furthermore, there is preferably a bearing of the axial bearing type formed by concentric, preferably annular surfaces on the fixed and on the movable unit, which surfaces are pressed against one another in a plane at right angles to the axis of rotation of said axially acting spring member.

One particular advantage of the invention is that the bearings can perfectly well be lubricated if, according to the invention, they are sealed in relation to the environment, which prevents dust and other impurities entering and mixing with the lubricant.

Further advantages of the invention and characteristics and aspects thereof emerge from the following patent claims and the detailed description of two possible embodiments.

BRIEF DESCRIPTION OF THE DRAWINGS

In the following detailed description of two embodiments of the invention, reference will be made to the attached drawings, in which.

DETAILED DESCRIPTION OF THE EMBODIMENTS

Figure 1:
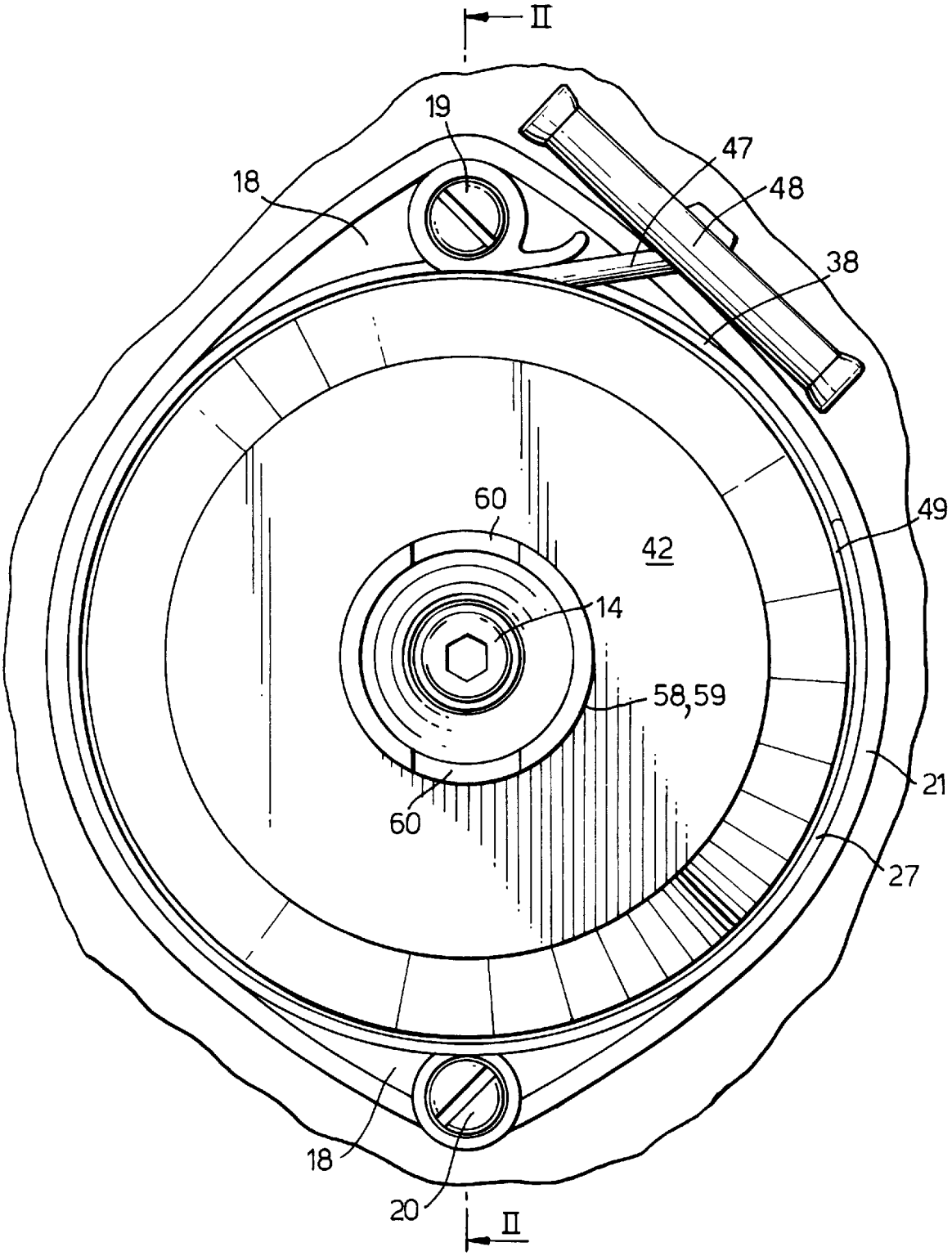
FIG. 1 represents a view of the starter device according to a first embodiment seen in the axial direction from the engine side, i.e. it shows the side which is intended to face the engine which is to be started by means of the starter device.
Figure 2:
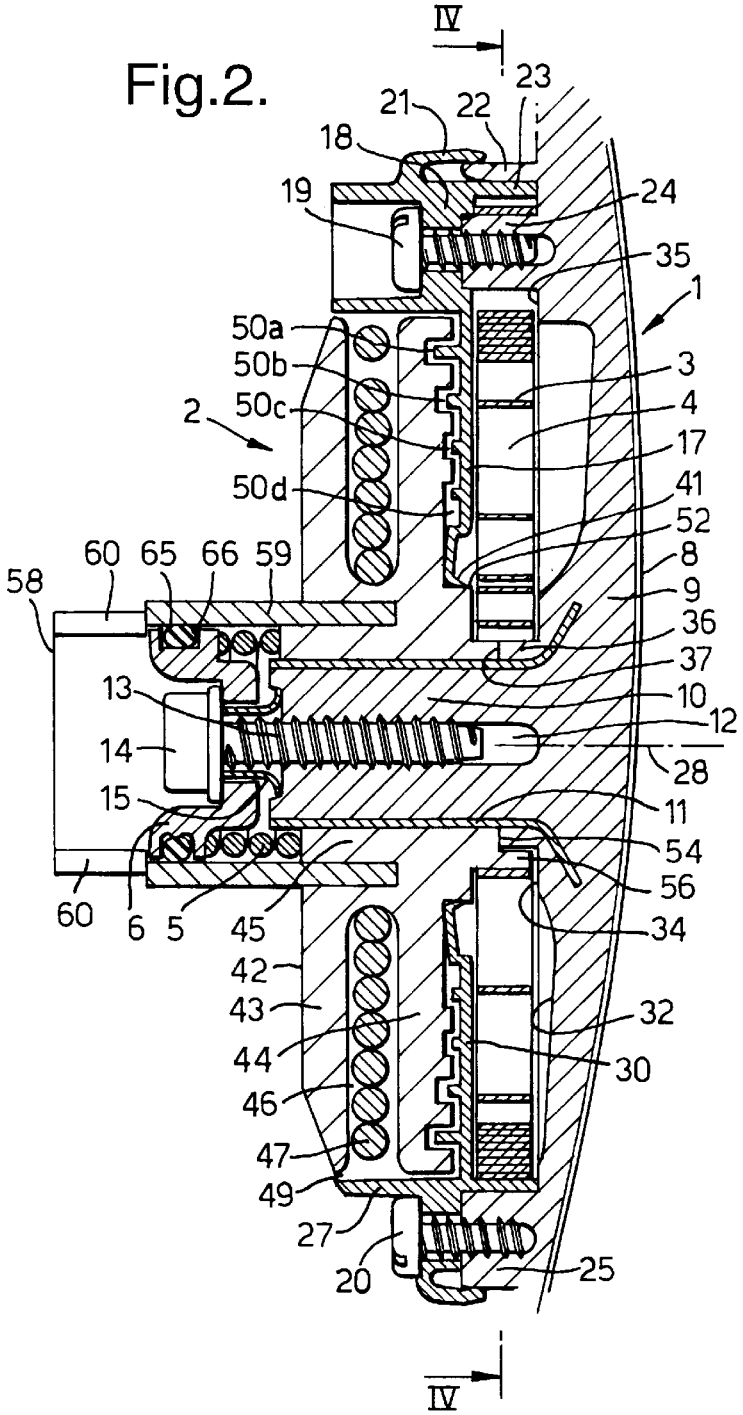
FIG. 2 shows the starter device in a cross-section along a line II—II in FIG. 1.
Figure 3:
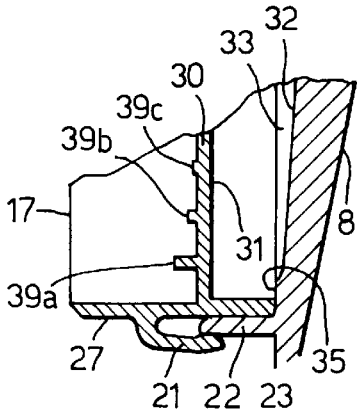
FIG. 3 shows part of two components forming part of the fixed unit of the starter device in a section at light angles to that in FIG. 2.

In the drawings, embodiments of a starter device for a petrol-driven engine in a portable work tool, more specifically a portable cutting machine, are shown. With reference first to FIG. 1–FIG. 4, the main parts of the starter device consist of a fixed unit 1, a movable unit 2, a return spring 3 of the helical type made of strip steel in a return spring chamber 4 and a compression spring 5 of the screw type between an element 6 (an inner cover) forming part of the fixed unit 1 and the movable unit 2.

The main part of the fixed unit 1 consists of a casing 8. This, and with it the entire starter device, is designed to be capable of being mounted on said machine by means of fastening devices (not shown), preferably screws. The outer part of the casing 8 is indicated by 9. From this outer part, a spindle 10 extends inwards. The peripheral part of the spindle 10 is constituted by a steel tube 11 which is cast into the casing 8. There is a central bore 12 in the spindle 10.

The element/the inner cover 6 is connected to the spindle 10 by means of a screw 13 which is screwed into the bore 12. Between the screw head 14 and the spindle 10, there is a sealing spacer 15.

Between the movable part 2 and the casing 8, there is an intermediate part 17 made of plastic. This has a pair of peripheral, diametrically opposite fastening lugs 18 with through-holes. Screws 19, 20 extend through these and are screwed tightly into raised screw attachments 24, 25 on the casing 8, as a result of which the intermediate part 17 is fastened to the latter and forms an integral part of the fixed unit 1.

A lip 21 extends around the intermediate part 17, which lip bears sealingly against the outside of an inwardly directed circumferential tongue 22 on the casing 8. The intermediate part 17 also bears—serves as a guide—against the casing 8 via a circumferential, outwardly directed flange 23, the outside of which bears against the tongue 22 on the casing. The screw attachment 24 also forms an outer attachment for the return spring 3.

In prolongation of the flange 23, a wall 27 extends some way inwards, parallel to the centre line 28 of the spindle 10, which line also represents the axis of rotation of the movable unit 2. In the wall 27, there is an opening 38 for a starter cord 47.

The flange 23 has the shape of a circular cylinder along the main part of its circumference. In the region of the spring attachment 24, however, the flange 23 extends in an outward direction taken from the centre line 28 so that a gap 29 is formed for the return spring 3 between the spring attachment 24 and the flange 23. The tongue 22 bears with the outside of a protuberance against the flange 23 in this region also. The tongue 22 also has a protuberance from its otherwise cylindrical shape in its diametrically opposite part, which part incorporates the second threaded attachment 25 for the second screw 20.

From the transition between the flange 23 and the cylindrical wall 27, a partition 30 extends radially inwards. The partition 30 forms an inner wall, seen in the axial direction, for the return spring chamber 4. The side 31 of the partition 30 facing the return spring chamber 4 is plane. The opposite side of the return spring chamber 4 is formed by the bottom surface 32 of a recess 33 in the outer part 9 of the casing 8. On the two sides of the recess 33, however, the casing 8 has an inner and an outer plane annular surface 34 and 35 respectively. Between these surfaces, radial grooves extend, which form support surfaces for the return spring 3. The outer part 9 of the casing also extends with a cylindrical part 36 some way up around the steel tube 11. This cylindrical part 36 ends in an annular surface 37 which forms an axial bearing surface for the movable unit 2 as will be described below.

The partition 30 also has, on the inside facing away from the return spring chamber 4, cylindrical projections 39*a, b, c,* etc., the projection 39*a* lying closest to the wall 27 being tallest, those following decreasing in height in the radial direction. These projections 39*a–d* form part of a labyrinth seal. In its innermost part in the radial direction, the partition 30 ends in a lip 41 forming part of a lip seal.

The movable unit 2 consists mainly of a moulded plastic body, designed as a cord drum 42. The cord drum 42 consists of an inner disc-shaped part 43 facing towards the machine (not shown), an outer disc-shaped part 44 facing the partition 30, and a hub part 45 which is mounted on the steel tube 11 of the spindle 10. Between the two disc-shaped parts 43 and 44, there is a cord slot 46 which accommodates the starter cord 47. The latter is at its inner end fastened in the bottom of the cord slot 46 and extends out through the opening 38 in the inner cylindrical wall 27 of the intermediate part 17. The outer end of the starter cord 47 is provided in a conventional manner with a pull handle 48. The cord drum 42 has an outer radius which is slightly smaller than the radius of the cylindrical wall 27 of the intermediate part 17 so that a narrow gap 49 is formed between the innermost part of the wall 27 and the outer circumferential edge of the inner disc-shaped part 43 of the cord drum. Correspondingly, there is a narrow gap between the wall 27 and the peripheral circumferential surface of the outer disc-shaped part 44 of the cord drum. The latter part has on its side facing the partition 30 annular grooves 50*a, b, c* and *d* located directly in front of corresponding projections 39*a–d* on the partition 30 so as to form together with these a labyrinth seal.

The hub part 45 has, outside the outer disc-shaped part 44, a cylindrical surface 52, against which the lip 41 on the partition 30 bears with a given spring action in order to provide a sealing effect. The hub part 45 also has a plane annular surface 54 at light angles to the axis of rotation 28, which surface bears against the axial bearing surface 37 on the casing 8, i.e. on the fixed unit.

Figure 4:
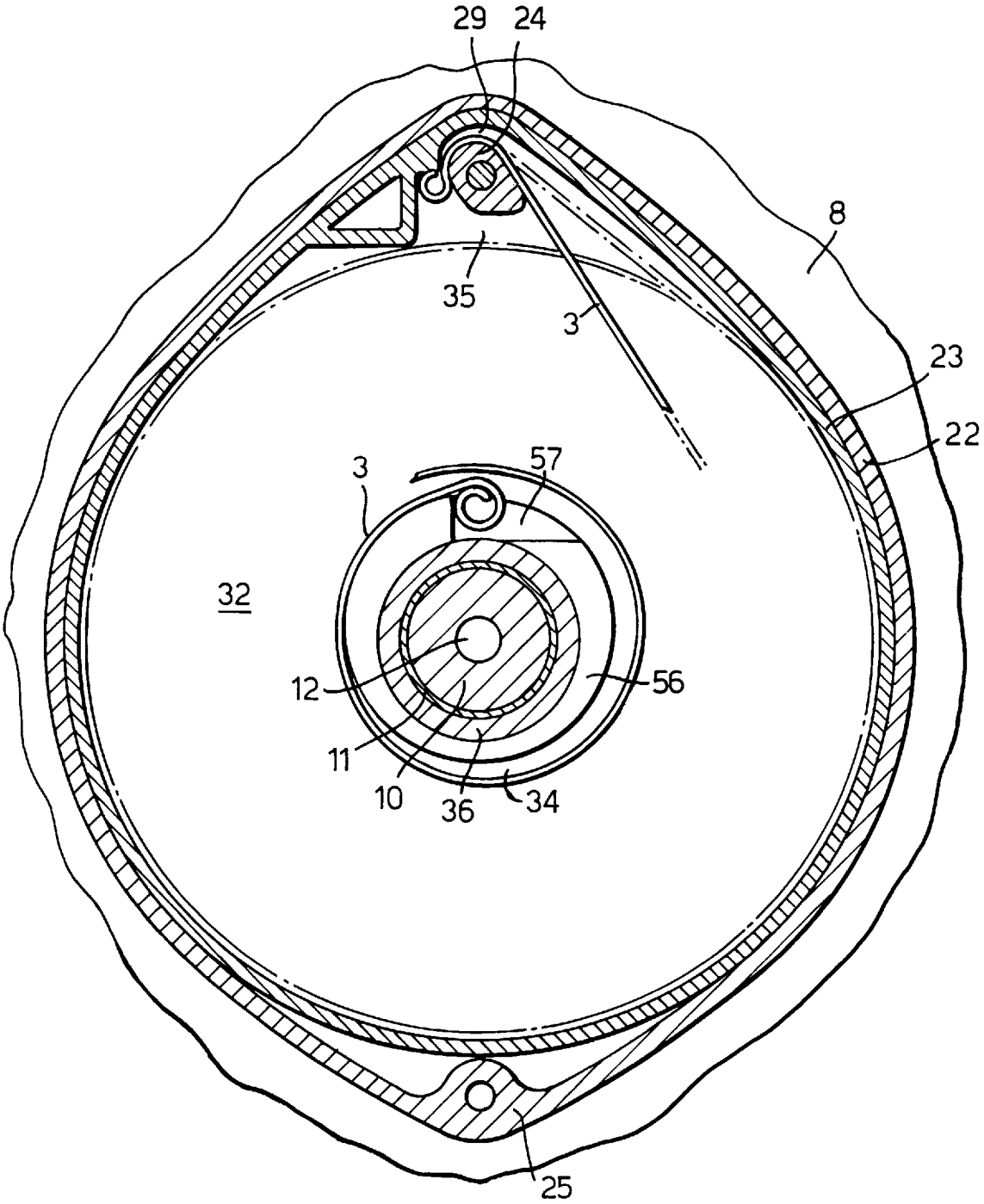
FIG. 4 represents a section along a line IV—IV in FIG. 2.

The hub part 45 ends at its end facing the casing 8 in a part 56 with a recess 57 which forms an inner attachment for the return spring 3 but which moreover extends around the cylindrical part 36 of the casing, FIG. 4.

The movable unit 2 also includes a driver device, generally indicated by 58, in the part of the movable unit which faces the engine which is to be stalled. The driver device 58 comprises a sturdy steel tube 59 which is embedded in the cord drum 52 outside the hub part 45 and extends into the cord drum until it is on a level with the outer wall of the cord slot 46. The steel tube 59, which is cylindrical, ends at its free end in a pair of recesses 60 for starting hooks or other members on a flywheel coupled to the engine shaft, which starting hooks are in engagement with the recesses 60 during the starting operation but are brought out of engagement with the recesses 60 as soon as the engine has been started, for example by centrifugal effect in a manner known per se. This function is well known and does not constitute a part of the present invention and can moreover be replaced by other coupling devices.

The compression spring 5 is clamped in between an inner annular plane surface 62 on the hub part 45 of the cord drum 42 and an outer annular plane surface 63 on the cover 6 which is included as an integral element of the fixed unit.

By means of the compression spring 5, the cord drum 42 is pressed with its annular surface 54 on the cylindrical part 43 of the hub part 45 against the annular bearing surface 37 on the cylindrical part 36 of the casing 8. The spring force developed by the compression spring 5 exceeds the vibration forces which the engine and the machine can transmit to the movable unit 2, as a result of which it is ensured that the two surfaces 54 and 37 remain pressed against one another, which in turn means that the movable unit 2 does not oscillate—does not "rattle"—or move in any other way relative to the fixed unit 1 as a result of the vibrations of the engine and the machine.

The fact that the movable unit 2 does not oscillate/vibrate/"rattle" relative to the fixed unit 1 as a result of the vibrations in the engine/the machine means among other things that the wear in the bearing between the movable and fixed units of the starter device remains entirely negligible. Said fact is also utilized according to the invention in order to create good and durable seals. A sealing O-ring 65 is thus an angled in an annular O-ring groove 66 in the cover 6. The O-ring 65 bears against the cylindrical inside of the steel tube 59 and seals the gap between the cover 6 and the steel tube 59 and with that also, together with the spacer 15, the radial bearing between the hub part 45 and the steel tube 11 and also the axial bearing of the cord drum 42 with its annular surface 54 against the annular bearing surface 37 on the casing 8.

Other sealing members between the movable and fixed units 2, 1 consist of the labyrinth seal 40 between the cord drum 42 and the partition 30 which forms a wall between the return spring chamber 4 and the cord drum 42 and also of the lip 41 which bears sealingly against the cylindrical surface 52 on the cord drum 42. By these means, dirt and other particles are prevented from penetrating the return spring chamber 4 via the gap 49 between the cord drum 42 and the cylindrical wall 27 of the intermediate part 17. The gap 49 itself also leads to a considerable reduction in the quantity of dust and other impurities which can find their way in. Lastly, the return spring chamber 4 is sealed by the intermediate part 17 bearing with the flange 23 against the casing 8 and by interaction between the circumferential lip 21 on the intermediate part 17 and the tongue 22 on the casing 8, the flange 23 guiding and the lip 21 sealing.

An important function of the O-ring seal 65 is in this connection also to prevent passage through the hub so that the labyrinth seal and the lip seal 21 and 41 are relieved. It will, however, be understood that the abovementioned sealing members only represent examples of how critical components in the starter device, such as the bearing and the return spring chamber 4, can be sealed on condition that the movable unit 2 is kept still relative to the fixed unit as soon as the engine has been started in a manner known per se by pulling the starter cord 47 so that the movable unit 2 is rotated about the spindle 10, the return spring 3 being tensioned in order subsequently to return the movable unit 2 to its initial position.

The fact that said radial and axial bearings are sealed in relation to the environment, so that dust and other impurities are essentially prevented from penetrating between the bearing surfaces, also means that these surfaces can advantageously be lubricated, so that on the one hand the starter device is easier to rotate with the aid of the starter cord and on the other hand the wear in the bearings is further reduced.

Figure 5:
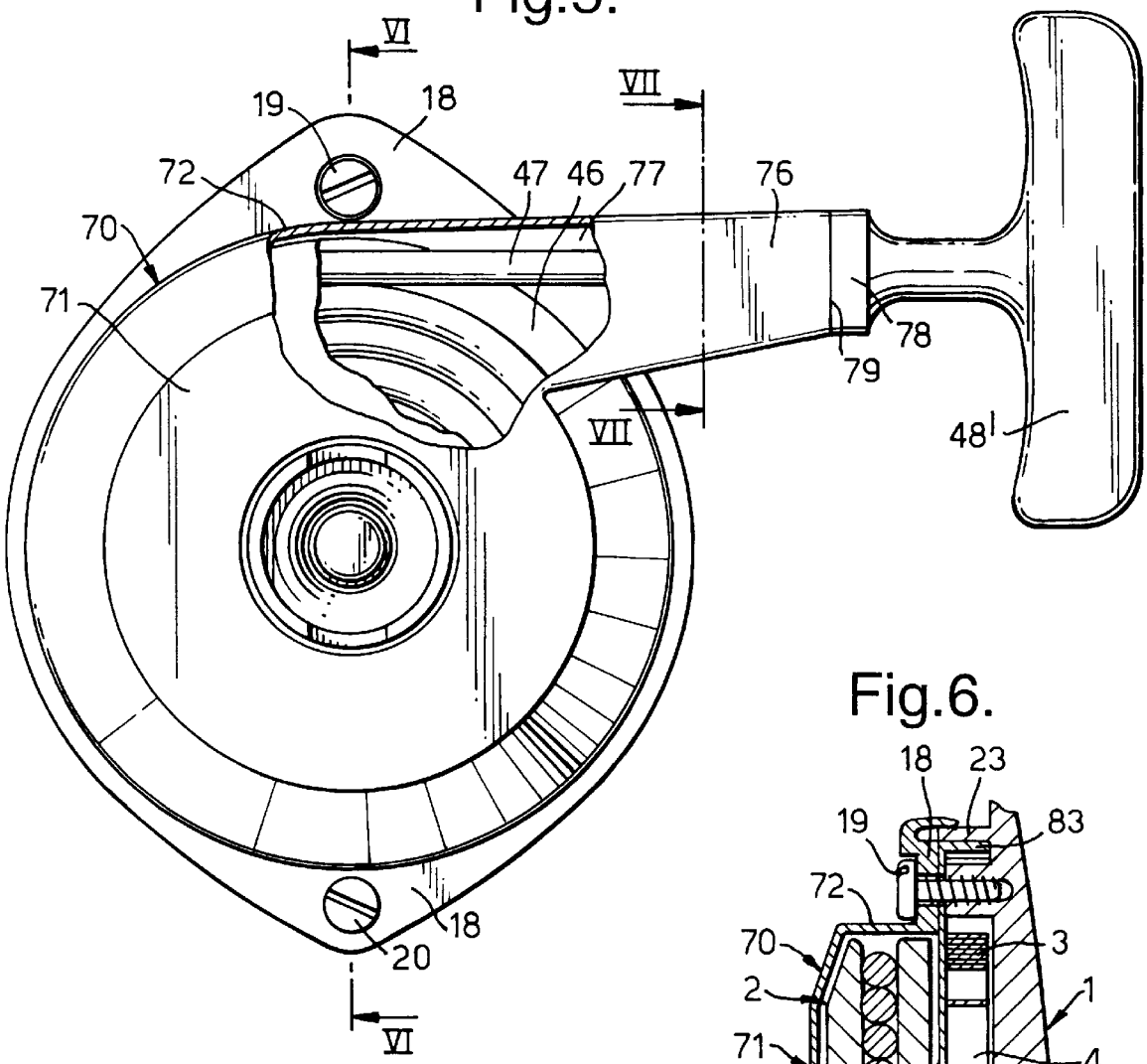
FIG. 5 represents a view of the starter device according to a second embodiment seen in the axial direction from the engine side, ie. it shows the side—partly cut away—which is intended to face the engine which is to be started by means of the starter device.
Figure 6:
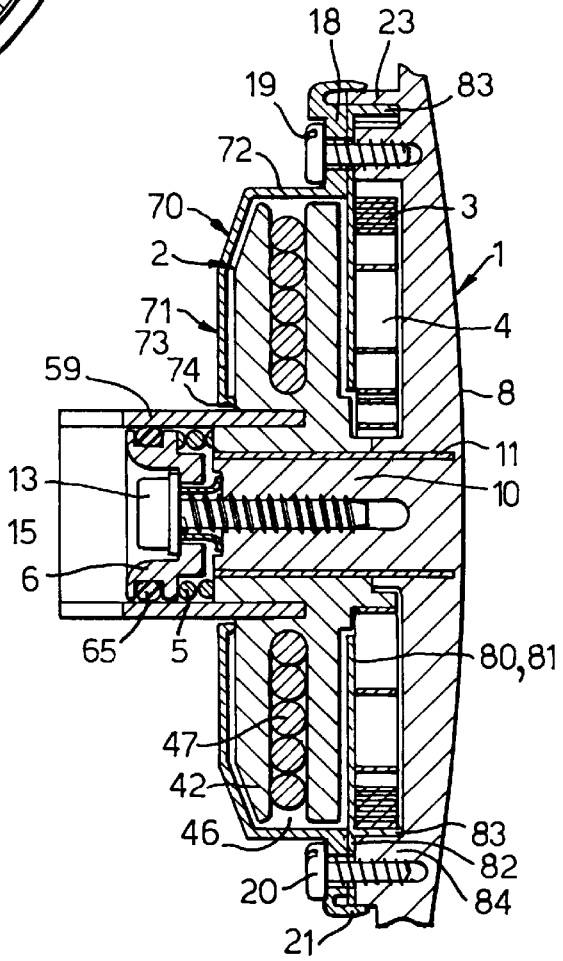
FIG. 6 shows the starter device in a cross-section along a line VI—VI in FIG. 5.
Figure 7:
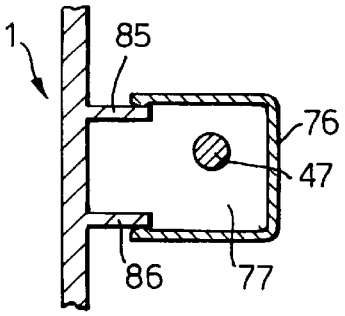
FIG. 7 shows a detail in cross-section along the line VII—VII in FIG. 5.

In the embodiment according to FIG. 5–FIG. 7, the following parts are constructed in the same manner as in the embodiment according to FIGS. 1–4, namely the casing 8 with the spindle 10 and its surrounding steel tube 11, the cover 6, which is connected to the spindle 10 by the screw 13, the spacer 15, the O-ring 65, the entire movable unit 2, the compression spring 5 between the cover 6 and the movable unit 2 and also the return spring 3 in the return spring chamber 4. These parts will therefore not be described further here but reference should be made to the preceding description with regard to these. The differences in relation to the preceding embodiment lie in the sealing of the cord slot 46 and of the return spring chamber 4.

According to the embodiment, the parts of the cord drum 42 which lie outside the hub part 42 and the embedded steel tube 59 are almost enclosed. The enclosing cover has been generally indicated as 70 in FIG. 6. It is fastened to the casing 8 by means of screws 19, 20 which extend through holes in the fastening lugs 18. A circumferential lip 21 seals against the outside of a flange 23 on the casing 8. Inside these peripheral parts of the cover 70, the cover is designed as an inner hood 71 with a cylindrical wall 72 which extends inwards from the peripheral part of the cover 70 adjoining the casing 8 so that the wall 72 covers the cord slot 46. Subsequently, the cylindrical wall 72 merges with an inner wall part 73 at a short distance from and parallel to the side of the cord drum 42 facing the engine. The wall 73 ends in an inwardly facing lip 74 which bears against the cord drum 42 close to the embedded steel tube 59. The lip 74 forms a sliding seal against the cord drum 42. The cover 70 is expediently made of plastic. Inside the cover 70 and inside the cord drum 42, there is an inner plastic disc 80. The main part of this consists of a plane part 81, the central main part of which forms a partition between the cover 70 and the return spring chamber 4, and a peripheral part 82 which is clamped firmly between the cover 70 and the casing 8. A circumferential flange 83 bears against the inside of the flange 23 and against the screw attachment 84 respectively and fixes the plastic disc 80 in its position.

According to the embodiment, the cover 70 also has a tangentially projecting part 76 which, in sealing interaction with a pair of correspondingly converging fins 85, 86 on the outside of the casing, forms a duct 77 for the starter cord 47. The end opening for the duct 77 thus formed is closed by a plate or plug 78 which constitutes the inner end part of a starter handle 48'. The starter cord 47 is fastened in the handle 48' and, with the aid of the return spring 3 and of the starter cord 47, the plate 78 is pressed with a given sealing effect against the end edge 79 of the neck part 76.

The cord chamber 46 and the return spring chamber 4 are thus sealed in relation to the environment by the cover 70 with its lip 74, which bears sealingly against the cord drum 42, by the plate 78, which closes the opening for the pull cord 47, and by the O-ring 65. Moreover, the partition 81 acts as a further obstacle to impurities, which have nevertheless found their way inside the cover 70, gaining access to the return spring chamber 4.

According to the invention, it is the sealing system described with reference to FIGS. 5–7 combined with the compression spring 5 which is to prevent vibrations in the starter device. Should this return spring be omitted or worn out, the sealing system described can nevertheless function for some considerable time as a valuable seal in order to prevent impurities gaining access to the cord chamber 46 and the return spring chamber 4.

Figure 8:
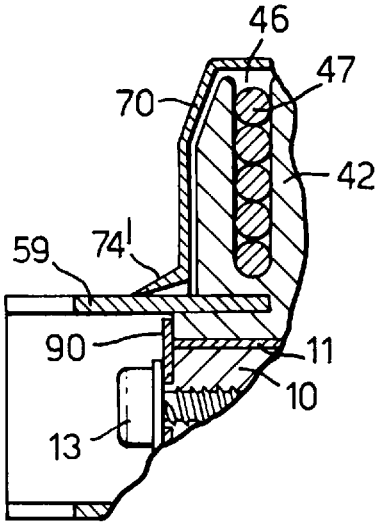
FIG. 8 shows part of the sealing members according to an alternative embodiment in the same section as FIG. 6.
Figure 9:
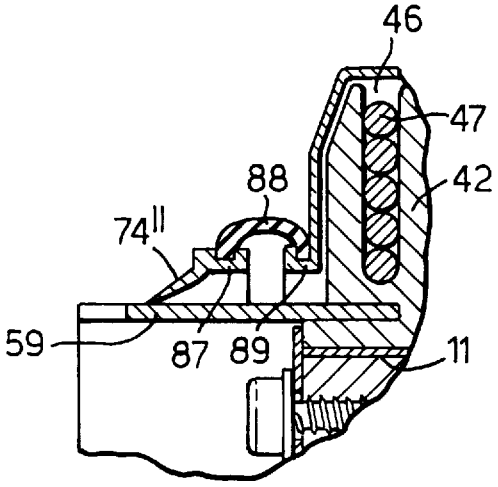
FIG. 9 illustrates an alternative embodiment of a sealing component.

In the embodiments according to FIG. 8 and FIG. 9, the compression spring 5 has been omitted and the sealing system developed further. In FIG. 8, the lip 74 according to FIG. 6 has thus been replaced by a lip 74' facing in the opposite direction, which seals against the steel tube 59, even if this should oscillate, especially oscillate in the axial direction. According to the embodiment, the inner cover 6 with the O-ring 65, FIG. 2 and FIG. 6, has also been omitted. Instead, a simple washer 90 has been arranged between the screw 13 and the steel tube 11 which forms part of the hub 10.

In the embodiment according to FIG. 9, there is also a lip seal 74" which bears against the steel tube 59. The lip seal 74" forms a projection on a ring 87 which, via a rubber collar 88, is fixed to a flange 89 on the cover 70. Otherwise, the arrangement according to FIG. 9 is designed in the same manner as the arrangement in FIG. 8. As a result of the flexibility of the rubber collar 88, the lip seal 74" can move laterally. As a result of this capacity and also as a result of the fact that, by sliding, it can remain in contact with the tube 59 even when the latter oscillates in the axial direction, a good sealing effect can be achieved irrespective of the directions of the vibrations.

It will be understood that the sealing members according to FIG. 8 and FIG. 9 can advantageously be combined with the compression spring arrangement according to the embodiments according to FIGS. 1–7.

We claim:

1. Starter device for an internal combustion engine, comprising a unit (1) which is fixed relative to the engine, a movable unit (2) which is rotatable relative to the fixed unit about an axis of rotation (28), included in the movable unit (2) a cord drum (42) with a starter cord (47) and a driver device (58) for direct or indirect rotation of the engine shaft on rotation of the cord drum by pulling the starter cord, a return spring chamber (4) accommodating a return spring (3) arranged to be tensioned when the movable unit is rotated by pulling the starter cord and subsequently, by resilience, to return the cord drum to its initial position, and also at least one bearing between said fixed and movable units (2, 1), characterized by at least one axially acting spring member (5) for pressing the movable unit in the axial direction against a member (36) forming part of the fixed unit, and also at least one sealing member (65, 40, 41) between the environment and at least one of said return spring chamber and said bearing.

2. Starter device according to claim 1, characterized in that said spring member presses the movable unit into a fixed position relative to the fixed unit.

3. Starter device according to claim 1, characterized in that the movable unit is pressed in the axial direction against the fixed unit with a force exceeding the axial pulse forces which act on the movable unit relative to the fixed unit as a result of vibrations in the engine and/or the machine or apparatus which is driven by the engine.

4. Starter device according to claim 1, characterized in that said at least one bearing comprises an axial bearing, and in that said at least one axially acting spring member is arranged to press the movable unit against the fixed unit in the region of the axial bearing (36, 37).

5. Starter device according to claim 4, characterized in that the axial bearing comprises an annular surface (37) on the fixed unit and in that an annular surface (54) on the movable unit is pressed against said annular surface (37) on the fixed unit.

6. Starter device according to claim 1, characterized in that said at least one bearing also comprises a radial bearing.

7. Starter device according to claim 6, characterized in that the radial bearing is formed by a hub part (45) in the movable unit, in which a spindle (10, 11) on the fixed unit is mounted.

8. Starter device according to claim 7, characterized in that an anally acting spring member (5) is arranged between the movable unit and an element (6) forming part of the fixed unit.

9. Starter device according to claim 8, characterized in that said element (6) is arranged in the axial prolongation of the spindle in the direction towards the engine which is to be started with the aid of the starter device.

10. Starter device according to claim 1, characterized by sealing members (65, 15) for sealing passages from the environment to said bearing or bearings.

11. Starter device according to claim 1, characterized by an intermediate part (17) comprising a partition (30) between the cord drum (42) and the return spring chamber (4), which partition is provided with at least one sealing member in order to counteract the entry of dust and other impurities to the return spring chamber from the environment via passages between the cord drum and the return spring chamber.

12. Starter device according to claim 11, characterized in that the mutually facing sides of the partition and the cord drum are designed with members **(39*a–d*, 50*a–d*) which together form a labyrinth seal (40)**.

13. Starter device according to claim 11, characterized in that the inner part of the partition in the radial direction is designed with at least one lip (41) which bears sealingly against at least one surface of revolution (52) on the cord drum.

14. Starter device according to claim 1, characterized in that the fixed unit comprises a casing (8) arranged to be capable of being fixed to said machine or apparatus which is driven by the engine.

15. Starter device according to claim 1, characterized in that the cord drum (42) is arranged between the fixed unit and a cover (70) which is connected to the fixed unit and which has an opening for a driver device (58) for interaction with the engine which is to be started.

16. Starter device according to claim 15, characterized in that the cover (70) comprises a hood which, with a wall part (72), covers a cord slot (46) in the cord drum.

17. Starter device according to claim 16, characterized in that said hood, with a wall part (73), also essentially covers the wall of the cord drum which faces said engine.

18. Starter device according to claim 16, characterized in that the hood is provided with a sliding seal (74, 74', 74") which forms a sliding seal bearing against the cord drum (42) or against a part (59) connected firmly to the cord drum.

19. Starter device according to claim 1, characterized in that said cover has a tangential projection (76) which forms a wall to a duct (77) for the starter cord (47).

20. Starter device according to claim 19, characterized in that said duct ends in an opening which is essentially closed by an element (78) connected to the starter cord.

* * * * *